US005692263A

United States Patent [19]

Sorenson

[11] Patent Number: 5,692,263

[45] Date of Patent: Dec. 2, 1997

[54] DELICATE DUSTING VACUUM TOOL

[76] Inventor: R. Wayne Sorenson, 14 Beaulyncove, Manitoba, Canada, R3T 594

[21] Appl. No.: 460,689

[22] Filed: Jun. 2, 1995

[51] Int. Cl.[6] ..... A47L 9/02

[52] U.S. Cl. ..... 15/415.1; 15/393; 15/420; 15/422; 15/396

[58] Field of Search ..... 15/393, 395, 396, 15/415.1, 422

[56] References Cited

U.S. PATENT DOCUMENTS

| | | | |
|---|---|---|---|
| D. 172,300 | 5/1954 | Penzato . | |
| 243,098 | 6/1881 | Beckgr et al. . | |
| 1,053,665 | 1/1913 | Spencer | 15/415.1 |
| 1,067,802 | 7/1913 | Dana . | |
| 1,601,774 | 10/1926 | Scheffer | 15/415.1 |
| 1,869,730 | 8/1932 | Antle | 15/395 X |
| 2,198,339 | 4/1940 | Hamilton | 15/395 |
| 2,778,441 | 1/1957 | Herriott . | |
| 2,811,738 | 11/1957 | Gall | 15/395 X |
| 3,009,188 | 11/1961 | Martin | 15/415.1 X |
| 3,147,509 | 9/1964 | Sieb . | |
| 4,161,802 | 7/1979 | Knight et al. | 15/415.1 X |
| 5,123,142 | 6/1992 | Miller | 15/393 |

FOREIGN PATENT DOCUMENTS

| | | | |
|---|---|---|---|
| 2164603 | 4/1973 | Germany | 15/415.1 |
| 395302 | 7/1933 | United Kingdom | 15/415.1 |

*Primary Examiner*—Chris K. Moore
*Attorney, Agent, or Firm*—Robert W. B. Bailey

[57] ABSTRACT

A vacuum tool for delicate dusting of plants and similar delicate fabrics has an inner and outer shell. The inner shell has a distribution of holes providing even volume of air flow per unit length of inner and outer shells. The outer shell has an even distribution of holes which provide even volume of air flow and air velocity per hole and also even suction over the outer shell. The outer holes are sunk within grooves so that fabric, leaves and petals and the like are not sucked against the holes and torn, ripped or frayed. The grooves also provide even suction over the surface of the outer shell.

20 Claims, 1 Drawing Sheet

DELICATE DUSTING VACUUM TOOL

This invention concerns a vacuum tool specially intended for delicate dusting of fragile items such as house plants.

Although the invention is described and referred to specifically as it relates to specific structures of vacuum tools for delicate dusting, it will be understood that the principles of this invention are equally applicable to similar structures and accordingly, it will be understood that the invention is not limited to such structures.

BACKGROUND OF INVENTION

Conventional commercially available vacuum cleaner tools have been found to damage live and artificial house plants when used in attempts to dust them. The edges of leaves and petals became frayed and torn. Close inspection showed that this damage was caused by the leaves and petals being sucked against then pulled into the vacuum tool, where turbulence is very great and creates violent thrashing around of the leaves and petals, which makes them fray and even rip. In short the suction air velocity and turbulence are far too great for the leaves and petals to withstand.

PRIOR ART

U.S. Pat. Nos. 243,098, Jun. 21, 1881 to Becker et al., 1,053,665, issued Feb. 18, 1913 to Spencer, 1,067,802, Jul. 22, 1913 to Dana, 2,778,441, Jan. 22, 1957, to Herrloft, D172,300 May 25, 1954 to Penzato, and 3,147,509 issued Sep. 8, 1964, to Sieb, all teach vacuum suction or air pressure devices.

It a principal object of the invention to provide a delicate dusting vacuum tool for house plants, live and artificial, and similar delicate fabric and objects which are damaged by normally commercially available vacuum tools. It is a further principal object to provide a double shelled delicate dusting vacuum tool providing even suction over its outer shell to dust delicate objects. It is a further principal object to provide a tool which does not rip, tear or fray fabric, leaves, petals and the like. It is a subsidiary object to provide an inner shell having the same volume of air flow per unit length of inner shell. It is a subsidiary object to provide an outer shell having the same volume of air flow per unit length of outer shell. It is a subsidiary object to provide an outer shell which does not rip, tear or fray fabric, leaves, petals and the like. It is a subsidiary object to provide suction holes in the outer shell within grooves which both provide even air flow over the outer shell and prevent ripping, tearing and fraying of fabric, leaves, petals and the like. Other objects will be apparent to those skilled in the art from the following specification, accompanying drawings and appended claims.

DESCRIPTION OF THE INVENTION

The first attempt to solve the problem used a modified crevice tool having a sealed end and an evenly distributed array of holes, which emphatically did not work. The holes farthest from the suction end produced hardly any air movement at all, while those closest to the suction end had far too much air movement sucking fabric, leaves and petals violently into the holes and tending to rip, tear, and fray them.

The second attempt to solve the problem produced a device somewhat similar to that of Spencer, in the above noted U.S. Pat. No. 1,053,665. The difference and distinction was that where Spencer teaches larger holes toward the end of the tool farthest from the suction source, applicant used holes of the same size throughout, but more toward the far end. This achieved the same volume of air flow per length of tool, but it had three drawbacks.

First, the leaves and petals of the plants were drawn so strongly against the tool and its holes that when the tool was withdrawn the leaves and petals were still being frayed and torn. Second, the parts of the plant which did not have the holes passing over them did not get cleaned properly, because those leaves and petals which did get drawn against the tool, were tightly drawn against the holes, which plugged or partly plugged stopping air flow in that area. Reducing hole size while increasing their number did not improve matters, the smaller holes tended to plug with dust and other matter. Third, although the volume of air flow was the same per unit length of the tool, the air velocity was greater at the suction end of the tool, than the far end of the tool. The same volume of air flow used less holes at the suction end than the remote end, so the remote holes had less volume of air flow per hole and thus less velocity and suction per hole. The far end of the tool did not clean as efficiently as the suction end.

The double shell design adopted included an inner shell having an increasing number of holes towards the outer end, and so even volume of air flow per unit length. The outer shell has an evenly spaced array of holes along its length providing even volume of air flow through each hole. The outer holes are at the bottom of grooves which are sufficiently narrow and deep to prevent the leaf, petal or fabric being sucked into the groove and consequently block the holes. The grooves have to be of different cross section to those taught in the tool shown by Herriott in the above noted U.S. Pat. No. 2,778,441. Herriott's grooves are broader and shallower than those contemplated in instant application, and would allow leaves, petals or delicate fabric, such as lace curtains, to be sucked against the holes, if used in instant device. The purpose of the grooves is to eliminate the possibility that leaves, petals and fabrics be drawn flush against the hole openings. The groove walls should be parallel to the axes of the holes in the outer shell. Also the grooves must run directly as straight as possible from one hole to the next. The groove bottom should also be as wide or at most slightly wider than the diameter of the holes in the groove bottom to ensure a good flow of air along the groove bottom and thus provided even suction over the surface of the outer shell.

Providing a single shell tool with holes distributed to provide even volume of air flow per unit length within grooves was considered, but it had already been shown that the resulting uneven suction cleaned inefficiently at the far end of the tool. Even suction is needed to provide efficient cleaning.

Gapped bumps surrounding the outer holes were considered instead of grooves, but smooth bumps would not prevent fabric, leaves and petals being sucked against the holes and ripped, torn or frayed, whereas sharp edged raised bumps would tend to rip, tear or fray material sucked against them.

In one broad aspect the invention is directed to a vacuum cleaning tool comprising inner and outer shell means. Both shell means have arrays of holes. The inner shell array of holes is configured to provide an even volume of air flow to each hole of the outer shell means. Preferably the tool has a near end and a far end and comprises suction tube means at the near end communicating with the inner shell means, which typically extends axially from the suction tube means toward the far end. The inner shell array of holes has the number of such holes per unit length increasing from the holes nearest the near end to those holes nearest the far end. Preferably the inner shell means has an array of axially spaced rows of inner holes, axially spaced a distance diminishing from the row closest the near end toward the far end. Typically the inner shell means has an annular cross section, and each row has annularly spaced inner holes, the holes in each row being staggered with respect to adjacent rows.

In a second broad aspect the invention is directed to a vacuum cleaning tool comprising outer shell means, which has an array of holes. The outer shell has therein groove means with base surface means and side surface means extending outward therefrom at a steep angle. The groove base surface means has therein outer shell holes, whereby air flow is directed along the groove means and material being cleaned is not sucked directly against the outer shell holes. Preferably the groove side surface means are substantially perpendicular to the groove base surface means. Preferably the outer holes have a diameter substantially equal to the width of the groove base surface means. Preferably the outer shell means has an array of spaced outer holes, which are substantially evenly distributed. Preferably the outer shell means has an array of axially spaced rows of outer holes, and each row of outer holes is annularly spaced, the holes in each row being staggered with respect to adjacent rows.

In a third broad aspect the invention is directed to a vacuum cleaning tool having a near end and a far end. There is suction tube means at the near end communicating with inner shell means, and outer shell means spaced apart from the inner shell means. The inner shell means extends axially from the suction tube means toward the far end. The inner shell means has an array of holes, the number of such holes per unit length increasing from the holes nearest the near end to those holes nearest the far end, whereby even volume of air flow per unit length of the inner shell is provided. The outer shell means encases the inner hole array of the inner shell means. The outer shell means has an array of spaced outer holes, which are substantially evenly distributed. The outer shell means has groove means, which have substantially even bottom surface means and steep angled side surface means. The groove base surface means has therein the outer shell holes, whereby volume of air flow is directed along the groove means and material being cleaned is not sucked directly against the outer shell holes. Preferably the groove side surface means are substantially perpendicular to the groove base surface means. Typically the outer holes have a diameter substantially equal to the width of the groove base surface means. Preferably the outer holes are substantially evenly distributed along said groove means. The outer shell means may have an array of axially spaced rows of outer holes. Each row of outer holes may be annularly spaced. The holes in each the row of outer holes are preferably staggered with respect to adjacent rows. Similarly the inner shell means may have an array of axially spaced rows of inner holes, which are axially spaced a distance diminishing from the row closest the near end toward the far end. Typically the inner shell means has an annular cross section, and each row has annularly spaced inner holes, which are staggered with respect to adjacent rows. Preferably the total area of the inner holes in the inner shell means is approximately equal to the total area of the outer holes in the outer shell means.

DESCRIPTION OF THE PREFERRED EMBODIMENTS

Figure 5:
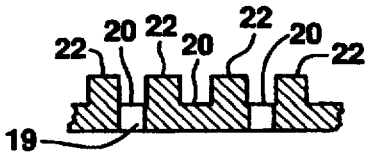
FIG. 5 shows a detail of the outer shell groove structure common to both embodiments.

The invention is now illustrated by reference to the preferred embodiments thereof. The numeral 10 indicates a delicate dusting vacuum tool of the invention, which includes vacuum or suction tube 12, outer shell 14, and inner shell 16. Inner shell 16 has therein an array of holes 17, which are equi-spaced transversely around the periphery in rows of 8 or 10 or so, the holes in each row are staggered with respect to adjacent rows, to provide even suction around the inner shell, in the embodiment shown in FIG. 1, 24 such rows are provided. The spacing between peripheral groups diminishes from the suction tube toward the remote end 18 of the inner shell 16, which has been found to provide even air flow volume per unit length of inner shell. The outer shell similarly has an array of holes 19, 30 such rows of holes are accommodated within transverse grooves 20, separated by ridges 22, although the grooves need not be transverse as shown, and could instead be longitudinal or spiral. As shown these rows are equi-spaced longitudinally of the tool, while the holes in each row are equi-spaced transversely of the tool and staggered with respect to adjacent rows. As shown most rows in the outer shell number 8 holes, with the two remotest from suction having less. As shown in FIG. 5, grooves 20 are about ⅛ inch and more preferably 3/32 inch wide at the bottom to accommodate 3/32 inch holes 19, while the intervening ridges 22 are about 1/16 inch wide and 3/64 and more preferably 1/16 inch deep, although as those skilled in the art would appreciate variation in dimensions is possible. Both the number of holes and ridges can be varied for the outer shell, and similarly the number of holes for the inner shell.

Figure 4:
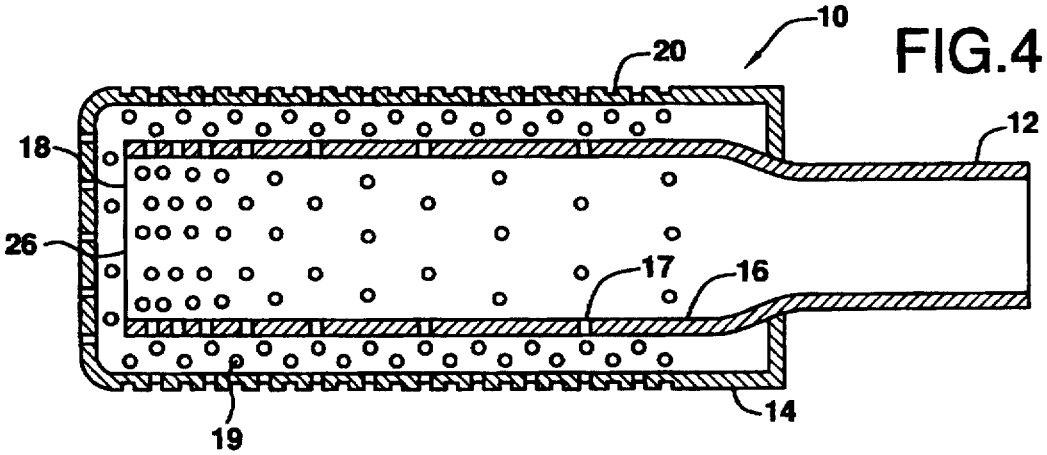
FIG. 4 shows a side sectional view of a further embodiment.

In the separate embodiment shown in FIG. 4, inner shell 16, which is formed from a modified crevice tool shown side on, has opening 26 at remote end 18, the inner shell holes consisted of 12 rows of 10 holes each, each row staggered with respect to neighboring rows, the distances between successive rows were ⅝, 9/16, ½, 7/16, ⅜, 5/16, ¼, 3/16, ⅛, and ⅛ inches proceeding from suction to remote end. Despite the open end 26, suction diminished steadily and was hardly noteworthy at the open end, and in fact the last ½ inch of the inner shell exerted very little suction. The outer shell contained transverse rows of 8 holes spaced ¾ inch apart around the tool, each row staggered with respect to its neighbors, with 3/16 inch between successive rows, the last two or three rows lacked grooves, about 210 holes were provided in 28 or so rows. All the holes in FIG. 4 were 3/32 inch.

It is desirable that the suction of the outer shell be approximately that of the vacuum itself, which is achieved by having the total area of the outer shell holes approximate that of the cross section of the suction tube. The number of inner holes is less critical. The inner holes should not be smaller than the outer shell holes to allow matter passing through the outer shell also to pass through the inner shell. The inner holes should also be as widely distributed as possible to provide an even flow of air to the outer shell holes, which is less probable the fewer and larger the inner shell holes. In practice the inner holes are desirably the same size as the outer shell holes, if the inner holes differ in size from each other, then they should enlarge as they are farther from the suction tube, but the smallest holes should not be smaller than the outer holes for efficient functioning. In FIG. 4, the total area of the holes of the inner shell including hole or gap 26 of the inner shell of about 0.7 square inches and 120 holes of 3/32 inch diameter, was approximately 1.53 square inches; the outer shell had 210 holes of 3/32 inch diameter in all approximately 1.45 square inches, as gap 26 is farthest from the suction its contribution is marginal. To all effects the suction area of inner and outer shells approximated to each other to provide reasonable cleaning suction over the outer shell. It is desirable in practice that the total areas of inner and outer shell apertures should closely approximate to each other. If gap 26 was not present, the number of holes would be roughly equal in both shells. This equality does not have to be an identity, the number of holes and their area does not have to be precisely or exactly equal, but is preferred to be approximately equal, as those skilled in the art can routinely determine the effective degree of equality required. Obviously if all the holes are the same size, which is convenient, it is simplest to have the same number of holes in each shell.

The size and shape of the holes is not particularly important as long as they provide even volume of air flow over the surface of the outer shell. In practice small circular holes are convenient.

Figure 1:
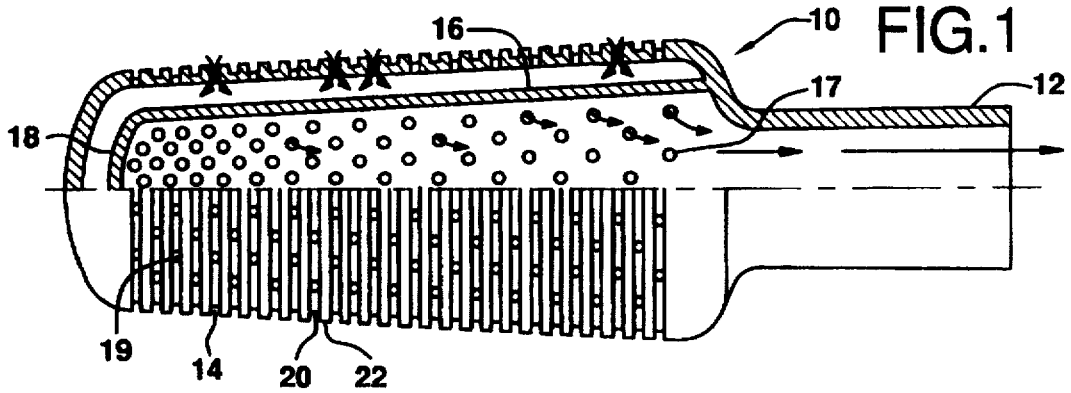
FIG. 1 shows a part sectional side view of an embodiment of the invention.
Figure 2:
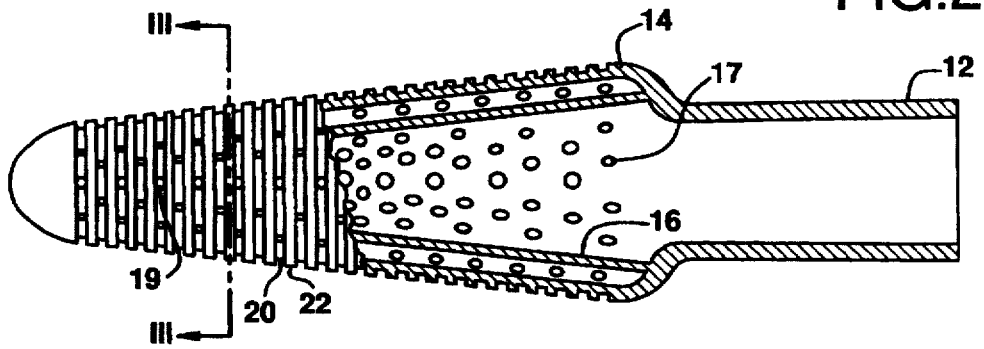
FIG. 2 shows a part sectional top view of the embodiment of FIG. 1.
Figure 3:
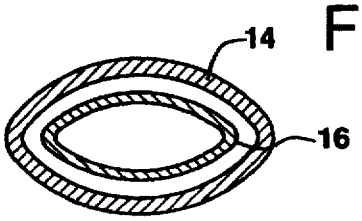
FIG. 3 shows a transverse sectional view of the embodiment of FIG. 1.

Although the tool is shown as integral in FIGS. 1 to 3, and having two components in FIG. 4, the invention is not restricted thereto, and can be assembled from a number of parts provided that on assembly these provide the essential features of the invention, as those skilled in the art would readily appreciate.

The tool is contemplated as manufactured from injection molded plastic parts, however as those skilled in the art would appreciate the tool can be manufactured in various ways from any number of conventional materials, without difficulty.

As those skilled in the art would realize these preferred described details and materials and components can be subjected to substantial variation, modification, change, alteration, and substitution without affecting or modifying the function of the described embodiments.

Although embodiments of the invention have been described above, it is not limited thereto, and it will be apparent to persons skilled in the art that numerous modifications and variations form part of the present invention insofar as they do not depart from the spirit, nature and scope of the claimed and described invention.

I claim:

1. A vacuum cleaning tool comprising inner and outer shells, said inner shell having an internal axis and a first tubular wall extending axially along said axis from a near end to a far end, said outer shell comprising a second tubular wall outward and spaced apart from said first tubular wall extending axially along said axis, both said shells having holes therein, said outer shell encasing the holes of said inner shell, the holes of said outer shell being substantially evenly distributed over the surface thereof, the holes of said inner shell being distributed to provide an even volume of air flow per unit axial length of said inner shell and an equal volume of air flow to each said hole of said outer shell.

2. A tool of claim 1 wherein said tool comprises a suction tube at said near end communicating with said inner shell.

3. A tool of claim 2, wherein said inner shell extends from said suction tube to adjacent said outer shell at said far end.

4. A tool of claim 3, wherein the number of holes of said inner shell per unit axial length increase from the holes nearest said near end to those holes nearest said far end.

5. A tool of claim 4, wherein holes of said inner shell comprise an array of axially spaced peripheral rows of inner holes, said rows being axially spaced a distance diminishing from said row closest said near end toward said far end.

6. A tool of claim 5, wherein said inner shell has an annular cross section, and each said row has annularly spaced inner holes, the holes in each said row being staggered with respect to adjacent rows.

7. A vacuum cleaning tool comprising an outer shell, said outer shell having an internal axis and a tubular wall extending axially along said axis from a near end to a far end, and a far end wall joining said tubular wall, said outer shell having holes substantially evenly distributed over the surface thereof, said outer shell having therein at least one groove having a base surface and side surfaces extending outward therefrom at a steep angle, said groove base surface having therein said outer shell holes, whereby volume of air flow is directed along said groove and material being cleaned is not sucked directly against said outer shell holes.

8. A tool of claim 7, wherein said groove side surfaces are substantially perpendicular to said groove base surface.

9. A tool of claim 7, wherein said outer holes have a diameter substantially equal to the width of said groove base surface.

10. A tool of claim 8, wherein said outer shell has an array of spaced outer holes, said holes being substantially equidistant from each other.

11. A tool of claim 10, wherein said outer shell has axially spaced rows of outer holes, and each said row of outer holes is annularly spaced, the holes in each said row being staggered with respect to adjacent rows.

12. A vacuum cleaning tool having a near end and a far end, comprising a suction tube at said near end communicating with an inner shell, and an outer shell spaced apart from said inner shell said inner shell having an internal axis and a first tubular wall extending axially along said axis from a near end to a far end said inner shell having holes in said first tubular wall the number of such holes per unit length increasing from the holes nearest said near end to those holes nearest said far end whereby even air flow volume per unit axial length of said inner shell is provided said outer shell having a second tubular wall outward and spaced apart from said first tubular wall extending axially along said axis, both said shells having holes therein, said outer shell encasing the holes of said inner shell, said outer shell having holes in said second tubular wall substantially evenly distributed over the surface thereof said outer shell having at least one groove therein, having substantially even base surface and steep angled side surfaces, said groove base surface having therein said outer shell holes, whereby air flow is directed along each said groove and material being cleaned is not sucked directly against said outer shell holes.

13. A tool of claim 12, wherein said groove side surfaces are substantially perpendicular to said groove base surface.

14. A tool of claim 12, wherein said outer holes have a diameter substantially equal to the width of said groove base surface.

15. A tool of claim 12, wherein said outer holes are substantially evenly distributed along each said groove.

16. A tool of claim 15, wherein said outer shell has an array of axially spaced rows of outer holes, and each said row of outer holes is annularly spaced, the holes in each said row of outer holes being staggered with respect to adjacent rows.

17. A tool of claim 12, wherein said inner shell has an array of axially spaced rows of inner holes, said rows being axially spaced a distance diminishing from said row closest said near end toward said far end.

18. A tool of claim 17, wherein said inner shell has an annular cross section, and each said row has annularly spaced inner holes, the holes in each said row of inner holes being staggered with respect to adjacent rows.

19. A tool of claim 17, wherein said outer shell has an array of axially spaced rows of outer holes, and each said row of outer holes is annularly spaced, the holes in each said row of outer holes being staggered with respect to adjacent rows.

20. A tool of claim 19 wherein the total area of the inner holes in the inner shell is approximately equal to the total area of the outer holes in the outer shell.

* * * * *